United States Patent [19]

Charlton et al.

[11] 4,396,094

[45] Aug. 2, 1983

[54] RETRACTABLE TROLLEY ESCAPE CAPSULE

[76] Inventors: Robert J. Charlton, 202 Skyline Dr., California, Pa. 15419; George J. Frich, R.D. 2, Box 135, Belle Vernon, Pa. 15012

[21] Appl. No.: 260,103

[22] Filed: May 4, 1981

[51] Int. Cl.[3] ..... E21D 7/02; B66B 15/06

[52] U.S. Cl. ..... 187/95; 187/27; 182/36; 182/142

[58] Field of Search ..... 187/12, 17, 20, 27, 187/95, 13, 14, 6, 96; 182/142–143, 36–37, 13–14

[56] References Cited

U.S. PATENT DOCUMENTS

| | | | |
|---|---|---|---|
| 430,073 | 6/1890 | Doyle | 187/20 |
| 481,888 | 8/1892 | Bergeron et al. | 187/6 |
| 944,113 | 12/1909 | Templer | 187/95 |
| 999,841 | 8/1911 | Nelson | 187/20 |
| 1,055,249 | 3/1913 | Williams | 187/13 |
| 3,702,124 | 11/1972 | Highland | 182/14 |
| 4,257,491 | 3/1981 | Presnall, Jr. et al. | 187/6 |

FOREIGN PATENT DOCUMENTS

| | | | |
|---|---|---|---|
| 1064703 | 9/1959 | Fed. Rep. of Germany | 187/96 |

*Primary Examiner*—Charles A. Marmor
*Assistant Examiner*—Russell D. Stormer
*Attorney, Agent, or Firm*—Howard I. Podell

[57] ABSTRACT

A guided lift cage which is pivotally mounted to a pair of fixed side rails by a suspension trolley so that the cage is always suspended on a vertical axis, regardless of the axis of the side rails. The path of the side rails may curve from a vertical axis within a shaftway to a horizontal axis above and outside of the shaftway to permit the storage and unloading of the cage, above the shaftway, at a position horizontally offset from the shaftway, to thus provide uninterrupted vertical access to the shaftway in the stored position of the cage.

3 Claims, 2 Drawing Figures

RETRACTABLE TROLLEY ESCAPE CAPSULE

FIELD OF THE INVENTION:

Our invention relates to a lift cage which is pivotally suspended from vertical or diagonally aligned side rails.

DESCRIPTION OF THE PRIOR ART:

The prior art, as exemplified by U.S. Pat. Nos. 1,125,918; 264,345; 81,677; 244,791; 4,111,281; 1,053,425; 1,541,144; 944,113; 1,713,165; 1,928,139; 2,309,123; 1,063,285; 3,227,245; 2,194,134; 673,301; 356,436; 3,666,051 and 656,204 is generally illustrative of the pertinent art but the aforementioned patents are non-applicable to the present invention. While the prior art expedients are generally acceptable for their intended purposes only, they do not meet the needs which have been solved by the instant invention, and would be inconvenient to use. As a result of the shortcomings of the prior art, typified by the above, there has developed a substantial need for improvement in this field.

The principle object of this invention is to provide a device or article of this character which combines simplicity, strength and durability in a high degree, together with inexpensiveness and safety of construction so as to encourage widespread use thereof.

Other objects of this invention will in part be obvious and in part hereinafter pointed out.

The invention accordingly consists in the features of construction, combinations of elements, and arrangement of parts which will be disclosed in this specification and recited in the claims of the application.

SUMMARY OF THE INVENTION:

Our invention is a guided lift cage which is pivotally mounted to a pair of fixed side rails by a suspension trolley so that the cage is always suspended on a vertical axis, regardless of the axis of the side rails. The path of the side rails may curve from a vertical axis within a shaftway to a horizontal axis above and outside of the shaftway to permit the storage and unloading of the cage, above the shaftway, at a position horizontally offset from the shaftway, to thus provide uninterrupted vertical access to the shaftway in the stored position of the cage.

BRIEF DESCRIPTION OF THE DRAWINGS:

The objects and features of the invention may be understood with the reference to the following detailed description of an illustrative embodiment of the invention, taken together with the accompanying drawings in which.

Figure 2:
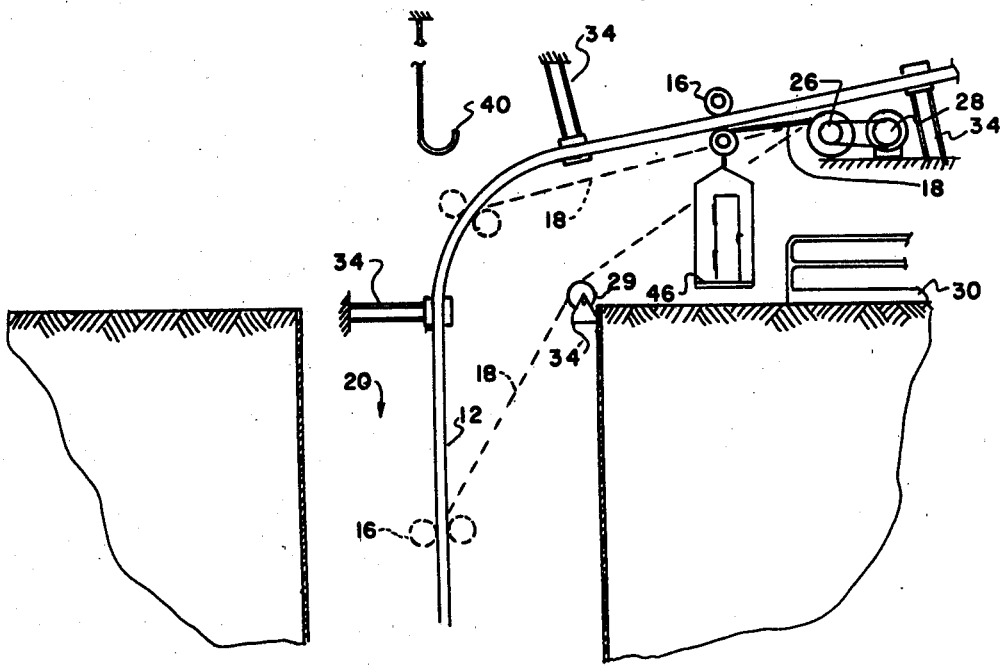
FIG. 2 is a side sectional view of the invention, in use.

DESCRIPTION OF THE PREFERRED EMBODIMENT:

Turning now descriptively to the drawings, in which similar reference characters denote similar elements throughout the several views, FIG. 2 illustrates a vertical shaft 20 such as employed for vertical lift of materials in a mine or construction shaft. A pair of spaced side rails 12 are mounted on opposed walls of shaft 20 to extend in vertical orientation down the shaft to the bottom of the shaft. Rails 12 project above the shaft opening 22 and then bend at a distance above the shaft mouth opening to extend along a generally diagonal path so as to extend above the landing platform 30 which is mounted at a distance from the shaft mouth. Each rail is fastened on its external side to support units 32 along its length which are mounted to the side walls of the shaft inside the shaft and to posts 34 outside the shaft.

A lift cage 10 is suspended by a swivel collar 2 trolley bridge pipe beam 14 with a pair of collar stops 13 maintaining swivel collar 2 in the center of beam 14. An end truck 15 is mounted on each end of beam 14, with a pair of rotatable trolley wheels 16 mounted on bearings that are fixed to the external end of each truck 15, so that each pair of wheels are slidably engaged to opposed sides of a side rail 12.

A suspension cable 18 is fastened by a harness to 19 to beam 14 and extends to a hoist drum 26 powered by a conventional hoist engine 28. Cable 18 may ride over an idler guide roller 29 mounted on the edge 34' of shaft opening 22.

As shown in FIG. 2, the hoist drum 26 and the landing platform are offset a considerable horizontal distance from the shaft mouth 22 so that a hoist cable 40 from another hoist unit (not shown) may be vertically lowered into the shaft 20, when the lift cage 10 is stored outside the shaft at the landing platform 30. The landing platform 30 is preferably supported above the ground level so that the floor 46 of the lift cage will swing free of the ground and of idler guide roller 29 at the near edge of the shaft mouth. Cage 10 may be enclosed in screen walls 51 fitted with a hinged door 52.

The cage 10 is supported by a cable harness 58 fastened through the swivel 2. Swivel 2 is mounted on a bearing about beam 14 so as to freely pivot to maintain cage 10 in constant vertical alignment regardless of whether the trolley wheels are engaged on a vertical section of the track rails in the shaft, or on a diagonal or horizontal section of the track rails above the shaft.

Figure 1:
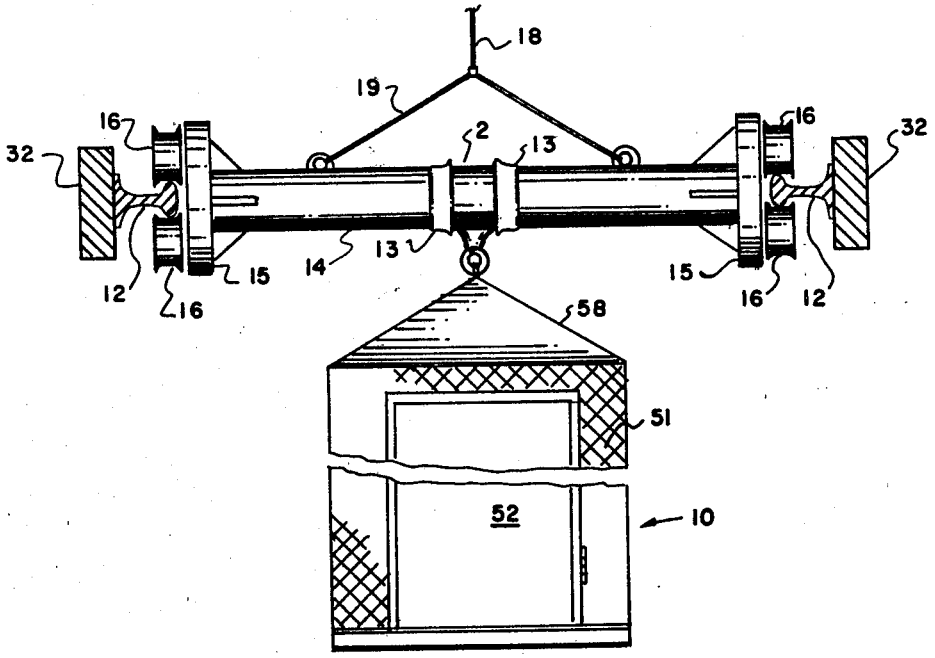
FIG. 1 is an elevated view of the lift cage fastened to the suspension trolley.

It can thus be seen that the retractable trolley manlift escape capsule provides an easy means of ingress or egress from a shaft with safety heretofor unavailable. The manlift's capsule always remains vertical, regardless of position inside the shaft or passing inside the shaft or passing outside the shaft to the retracted or stored position, shown in FIG. 2. The unique trolley assembly shown in FIG. 1 maintains alignment and results in the manlift capsule always remaining vertical regardless of its position in the shaft, in motion ascending, descending, or at rest on top of the retracted stored position offset from the axis of the shaft, or when it rests on the shaft bottom inside the shaft.

Our invention, the retractable trolley manlift escape capsule, provides a guided manlift which is lowered and raised by conventional hoisting methods, and provides a safe capsule storage when not in use, off to the side and out of the shaft axis where it is protected from the hazard of damage from mine or other types of shaft explosions, while remaining available, on demand, for ingress and egress from the shaft. The trolley guide rails extend on an inclined axis, tangent to the curved rails in the landing area, to the curved rails and into the vertical rails of the shaft, providing a positive start for the manlift into the shaft when the hoist is started to enable capsule descent. The guide rails are attached to the shaft walls, or other structure, by conventional positive support means. Additional safety is provided by enabling ingress and egress, above ground, from the capsule at a protected landing of platform precluding persons having to step over from an escape cage, an open shaft.

Since obvious changes may be made in the specific embodiment of the invention described herein, such modifications being within the spirit and scope of the invention claimed, it is indicated that all matter contained herein is intended as illustrative an not as limiting in scope.

Having thus described the invention, what I claim as new and desire to secure by Letters Patent of the United States is:

1. A guided lift cage apparatus adaptable for use as a safety escape unit from the interior of a vertical shaft having a mouth opening, comprising a pair of overhead, spaced, side rail members, each mounted so that a first vertical section thereof extends in parallel vertical array at a spaced distance from the central vertical axis of said vertical shaft, each of said rails extending vertically above the mouth opening of the shaft and including a second curved section that extends tangent from said first rail section and a third rail section that extends a horizontal distance away from the mouth opening of said shaft, a lift cage of a size to freely fit between said spaced side rail members, a trolley beam assembly fitted at each end thereof with rotary means which each engage a said rail member so as to permit the trolley beam to freely move in the direction of the axis of the rail, swivel means for suspending said cage to said beam assembly to maintain said cage suspended on a vertical axis at all times, at least one hoisting cable fastened to said trolley assembly for raising or lowering said trolley assembly and cage in said shaft, above, and to a side of the shaft outside said shaft, whereby in a stored position of the shaft, said cage is outside of the offset by a horizontal distance from the mouth opening of the shaft, a hoist winch drum for actuating said cable; said drum being offset at a horizontal distance from said shaft mouth, a landing platform mounted at a horizontal distance from said shaft opening, an idler guide roller mounted adjacent an edge of the mouth of the shaft so as to permit a hoisting cable fastened to the trolley assembly to extend along an axis inclined to the vertical from said trolley assembly, when in the shaft, to said idler roller and to extend along a diagonal axis from said roller to said hoist winch.

2. The apparatus of claim 1, wherein said rotary means comprise a pair of rollers rotatably mounted on said beam assembly and engaging said rail from above and below.

3. The apparatus of claim 1, wherein said winch drum is mounted on the same side of said shaft mouth as said landing platform.

* * * * *